US005545267A

United States Patent [19]

Ochi et al.

[11] Patent Number: 5,545,267

[45] Date of Patent: Aug. 13, 1996

[54] STEEL PRODUCT FOR INDUCTION-HARDENED SHAFT COMPONENT AND SHAFT COMPONENT USING THE SAME

[75] Inventors: Tatsuro Ochi; Yoshiro Koyasu, both of Muroran, Japan

[73] Assignee: Nippon Steel Corporation, Tokyo, Japan

[21] Appl. No.: 335,773

[22] PCT Filed: Mar. 14, 1994

[86] PCT No.: PCT/JP94/00403

§ 371 Date: Nov. 10, 1994

§ 102(e) Date: Nov. 10, 1994

[87] PCT Pub. No.: WO94/20645

PCT Pub. Date: Sep. 15, 1994

[30] Foreign Application Priority Data

Mar. 12, 1993 [JP] Japan ..... 5-052598
Apr. 20, 1993 [JP] Japan ..... 5-093397

[51] Int. Cl.[6] ..... C22C 38/22

[52] U.S. Cl. ..... 148/335; 148/334; 148/904; 420/105

[58] Field of Search ..... 148/334, 335, 148/904; 420/106, 105, 111, 110

[56] References Cited

U.S. PATENT DOCUMENTS 3,044,872 7/1962 Hayes et al. .
4,634,573 1/1987 Yanagiya et al. ..... 420/127
5,168,768 2/1993 Nonoto et al. ..... 420/110
5,279,688 1/1994 Isokawa et al. ..... 148/330

FOREIGN PATENT DOCUMENTS 0694557 10/1979 Russian Federation ..... 148/334

*Primary Examiner*—Deborah Yee
*Attorney, Agent, or Firm*—Kenyon & Kenyon

[57] ABSTRACT

The present invention provides a steel product, for all induction-hardened shaft component, which can prevent quench crack and has an excellent torsional strength of not less than 160 kgf/mm$^2$, and a shaft component using the steel product.

The subject matter of the present invention resides in a steel product for an induction-hardened shaft component comprising C: 0.35 to 0.70%, Si: more than 0.15 to 2.5%, Mn: 0.2 to 1.5%, Cr: 0.20 to 1.5%, Mo: 0.05 to 0.5%, Al: 0.015 to 0.05%, N: 0.002 to 0.02% and other ingredients, reduced amounts of P, Cu and O, further comprising particular amounts of Ti, B and the like, and an induction-hardened shaft component using the steel product, which shaft component has an average in-section hardness HVa of not less than 560, a grain size number of prior-austenite in an induction-hardened layer of not less than 9 and a surface residual stress of not more than −80 kgf/mm$^2$.

12 Claims, 4 Drawing Sheets

STEEL PRODUCT FOR INDUCTION-HARDENED SHAFT COMPONENT AND SHAFT COMPONENT USING THE SAME

TECHNICAL FIELD

The present invention relates to a steel product for an induction-hardened shaft component and a shaft component using the steel product. More particularly, the present invention relates to a steel product suitable for a shaft component, constituting a power train system in an automobile, such as a shaft provided with splines, a shaft provided with a flange and a shaft provided with a casing as shown in FIGS. 1(*a*) to 1(*c*), and an induction-hardened shaft component having excellent torsional strength. In FIGS. 1(*a*) to 1(*c*), numeral 10 designates a shaft, numerals 11, 12 designate serrations, numerals 20, 21 designate shafts, numeral 22 designates a flange, numerals 30, 31, 32 designates shafts and numeral 33 designates a casing.

PRIOR ART

Shaft components constituting a power train systems in automobiles have been generally been produced by forming a medium carbon steel into a desired component and then subjecting the components to induction hardening and tempering. In recent years, however, there has been a strong demand for an increase in strength (an improvement in torsional strength) due to the increase in engine output of automobile engines and to cope with environmental regulations.

Japanese Examined Patent Publication (Kokoku) No. 63-62571 discloses a process for producing a drive shaft comprising the steps of: forming a steel comprising C: 0.30 to 0.38%, Mn: 0.6 to 1.5%, B: 0.0005 to 0.0030%, Ti: 0.01 to 0.04% and Al: 0.01 to 0.04% into a drive shaft and subjecting the drive shaft to induction hardening in such a manner that the ratio of the induction hardening depth to the radius of the steel member is not less than 0.4. As can be seen from FIG. 1 of the same publication, the maximum attainable torsional strength is about 160 kgf/mm$^2$.

Japanese Unexamined Patent Publication (Kokai) No. 4-218641 discloses that the use of a steel product for a high-strength shaft component produced using a particular composition system characterized by low Si and high Mn contents, i.e., comprising Si: not more than 0.05% and Mn: between 0.65% and 1.7%, enables a torsional strength of 140 to 160 kgf/mm$^2$ to be obtained in a component provided with a spline.

Thus, the maximum torsional strength attainable in the art is about 160 kgf/mm$^2$.

However, the above torsional strength level of 160 kgf/mm$^2$ cannot be said to be satisfactory for shaft components in power train systems for automobiles. Further, the prevention of quench crack in the course of the production of the components has become important.

DISCLOSURE OF THE INVENTION

An object of the present invention is to provide a steel product, for induction-hardened shaft components, which has a torsional strength of not less than 160 kgf/mm$^2$ and does not cause quench crack, and a shaft component using the steel product.

The subject matter of the present invention is as follows.

(1) A steel product for an induction-hardened shaft component, characterized by having a chemical composition comprising by weight C: 0.35 to 0.70%, Si: more than 0.15 to 2.5%, Mn: 0.2 to 1.5%, Cr: 0.20 to 1.5%, Mo: 0.05 to 0.5%, S: more than 0.01 to 0.15%, Al: 0.015 to 0.05%, and N: 0.002 to 0,020%, and further comprising P, Cu and O in amounts limited to P: not more than 0.015%, Cu: not more than 0.05%, and O: not more than 0.002%, with the balance consisting of Fe and unavoidable impurities.

(2) A steel product for an induction-hardened shaft component according to the above item (1), which further comprises one or more members selected from Nb: 0.005 to 0.1%, V: 0.03 to 0.5%, and Ti: 0.005 to 0.05%.

(3) A steel product for an induction-hardened shaft component, characterized by having a chemical composition comprising by weight C: 0.35 to 0.70%, Si: more than 0.15 to 2.5%, Mn: 0.2 to less than 0.6%, Cr: 0.40 to 1.5%, Mo: 0.05 to 0.5%, S: more than 0.01 to 0.15%, Al: 0.015 to 0.05%, Ti: 0.005 to 0.05%, B: 0.0005 to 0.005%, and N: 0.002 to 0.010%, and further comprising P, Cu and O in amounts limited to P: not more than 0.015%, Cu: not more than 0.05%, and O: not more than 0.0020%, with the balance consisting of Fe and unavoidable impurities.

(4) A steel product for an induction-hardened shaft component according to the above item (3), which further comprises one or both of Nb: 0.005 to 0.1% and V: 0.03 to 0.5%.

(5) A steel product for an induction-hardened shaft component according to any one of the above items (1) to (4), which further comprises Ni: 0.1 to 3.5%.

(6) A steel product for an induction-hardened shaft component according to any one of the above items (1) to (5), which further comprises one or both of Ca: 0.0005 to 0.005% and Pb: 0.05 to 0.5%.

(7) An induction-hardened shaft component according to any one of the above items (1) to (6), characterized in that the average in-section hardness HVa, defined by the following formula (1), is not less than 560:

Average in-section hardness HVa:

$$HVa = \left( \sum_{n=1}^{N} HV_n \times r_n^2 \times \Delta r_n \right) \times \frac{3}{a^3} \quad (1)$$

wherein, when a section having a radius of a is concentrically divided in a radial direction into N rings, $HV_n$ is the hardness of the nth ring, $r_n$ is the radius of the nth ring and $\Delta r_n$ is the space of the nth ring.

(8) An induction-hardened shaft component according to the above item (7), characterized in that the grain size number of an prior-austenite in an induction-hardened layer is not less than 9.

(9) An induction-hardened shaft component according to the above items (7) and (8), wherein the surface residual stress is not more than −80 kgf/mm$^2$.

BEST MODE FOR CARRYING OUT THE INVENTION

The present invention has been made as a result of research and development of a steel product through induction hardening, which steel product is free from the occurrence of quench crack, has a torsional strength of not less than 160 kgf/mm$^2$ and can be used in shaft components in a power train system for automobiles.

The present inventors made extensive and intensive studies with a view to realizing shaft components having excellent torsional strength by induction hardening and, as a result, have found the following facts.

(1) In the case of ductile fracture, the torsional strength of the induction-hardened material improves in proportion to the average in-section hardness as defined below. Extrapolation from the relationship between the torsional strength and the average in-section hardness shows that in order to attain an excellent torsional strength of not less than 160 kgf/mm$^2$, it is necessary for the HVa value to be not less than 560.

Figure 1A:
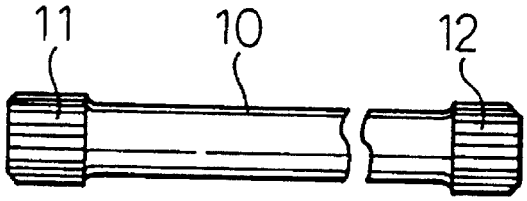
FIG. 1(*a*) is a diagram showing a shaft provided with splines, FIG. 1(*b*) a diagram showing a shaft provided with a flange, and FIG. 1(*c*) a diagram showing a shaft provided with a casing.
Figure 1B:
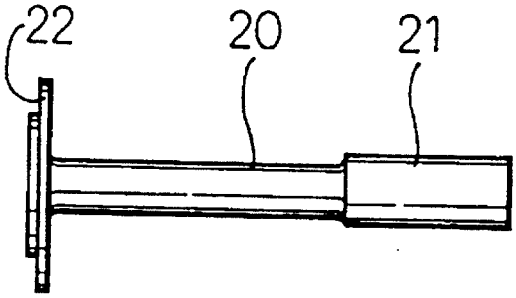
Figure 1C:
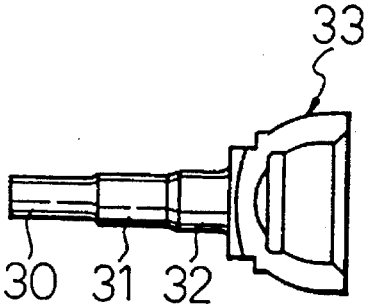
Figure 2:
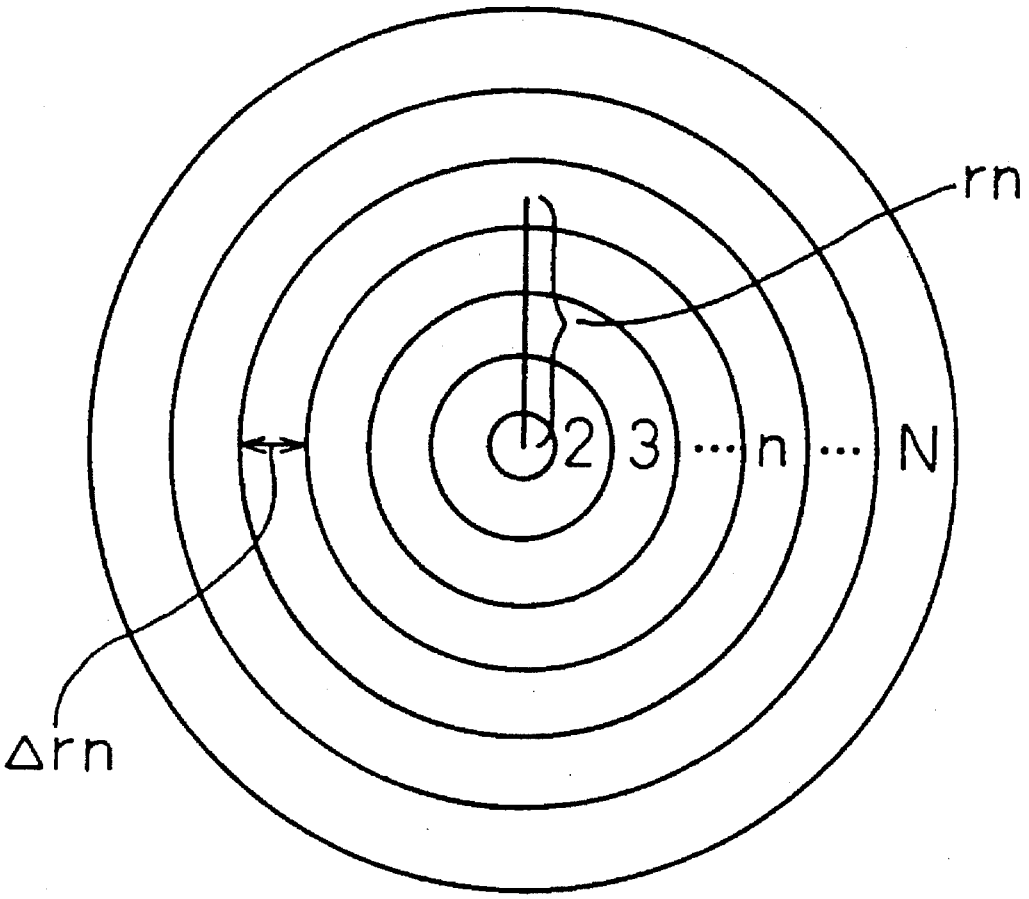
FIG. 2 is a diagram for explaining the definition of in-section average hardness wherein the section has been concentrically divided into n rings.

Definition of average in-section hardness:

The average in-section hardness is defined by the following equation:

Average in-section hardness $$HVa = \left( \sum_{n=1}^{N} HV_n \times r_n^2 \times \Delta r_n \right) \times \frac{3}{a^3}$$

wherein, when a section having a radius of a is concentrically divided in a radial direction into N rings as shown in FIG. 2, $HV_n$ is the hardness of the nth ring, $r_n$ is the radius of the nth ring and $\Delta r_n$ is the width of the nth ring.

The above definition was established based on the following findings.

Figure 3A:
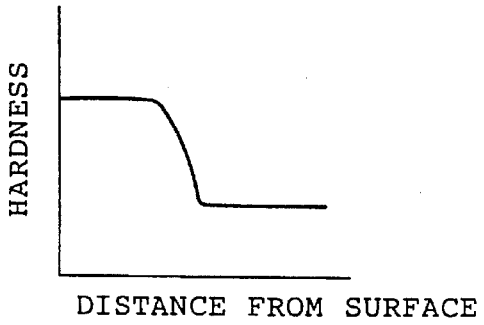
FIG. 3(*a*) is a diagram showing the relationship between the hardness and the distance from the surface in the case where, in the course of torsional deformation of a shaft component, the plastic deformation proceeds from the surface of the shaft component towards the inside thereof, FIG. 3(*b*) is a diagram showing the relationship between the torque and the angle, and FIG. 3(*c*) is a typical diagram showing the shear strain and the shear force.
Figure 3B:
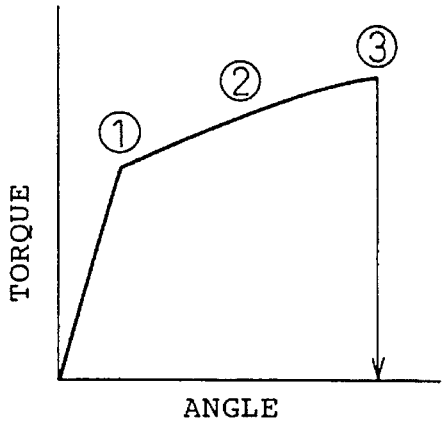
Figure 3C:
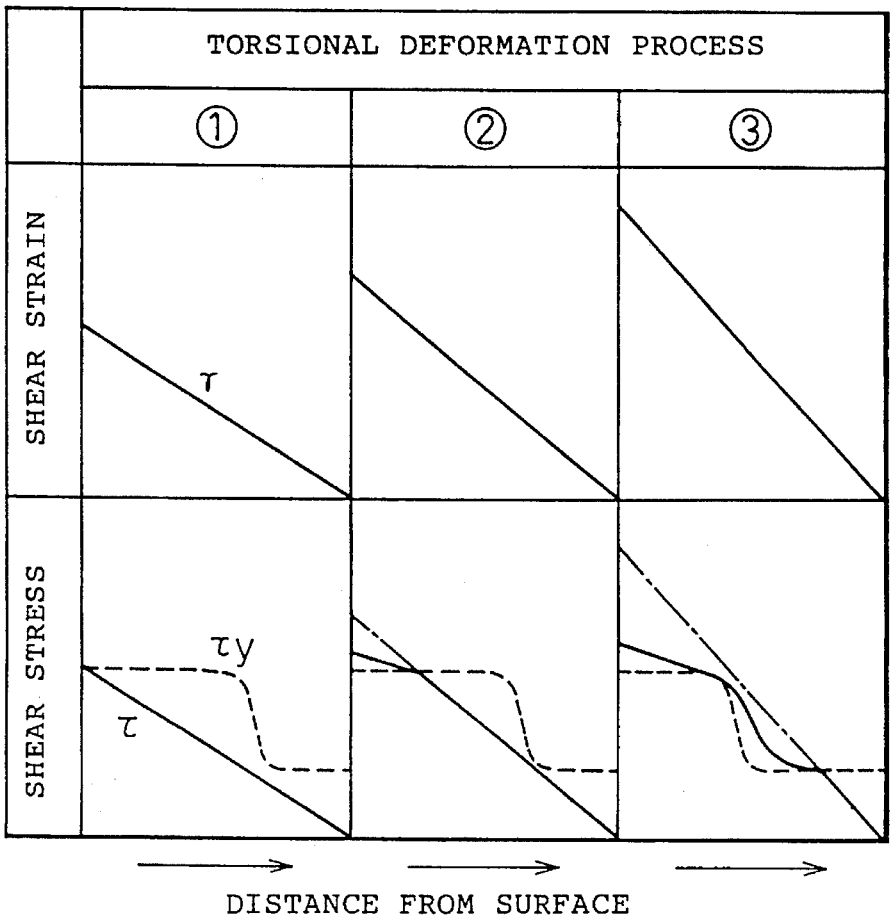

FIG. 3(*c*) is a typical diagram showing the shear strain and the shear stress in the case where, in the course of torsional deformation of a shaft component, the plastic deformation proceeds from the surface of the shaft component toward the inside thereof. In the drawing, a solid line represents a shear strain distribution, a thick solid line represents a shear stress distribution, and a dotted line represents a shear yield stress distribution. When the torque is ①, at the surface, the shear stress τ reaches the shear yield stress τy of the steel product, starting plastic deformation. When the torsional deformation proceeds until the torque reaches ②, the plastic deformation proceeds toward the inside of the material while causing work hardening (in the drawing, the difference between the dotted line and the solid line in the surface layer portion corresponding to the degree of work hardening). In the drawing, the alternate long and short dash line represents an imaginary shear stress distribution curve under the assumption that ho plastic deformation occurs. Further, in FIG. 3(*b*), when the torque is ③ slightly over the value at which the torsional fracture occurs, the plastic deformation proceeds to the vicinity of the center portion.

The torque $M_t$ for any shear stress distribution τ(r) is given by the following equation (2):

$$M_t = 2\pi \int_0^a \tau(r) r^2 dr \quad (2)$$

wherein a represents the radius.

On the other hand, the apparent shear fracture stress $\tau_{max}$ assuming an elastic fracture, which is generally used as a measure of the torsional strength, is determined by the following equation (3):

$$\begin{aligned} \tau_{max} &= \frac{2M_t}{\pi a^3} \\ &= \frac{4}{a^3} \int_0^a \tau(r) r^2 dr \\ &= \frac{4}{a^3} \int_0^a \tau_f(r) r^2 dr \end{aligned} \quad (3)$$

wherein $\tau_f(r)$ represents the shear stress distribution at the time of fracture.

Since the steel product is a medium or high carbon martensite steel, in which the degree of work hardening is assumed to be small, the shear stress distribution at the time of fracture is substantially in agreement with the shear yield stress distribution, as is apparent from FIG. 3(*c*). Therefore, the shear stress distribution at the time of fracture can be approximated as a function of the hardness distribution by $\tau_f(r) = K_1 \cdot HV(r)$.

$$\tau_{max} = \frac{4K_1}{a^3} \int_0^a HV(r) r^2 dr \quad (4)$$

Here the corresponding hardness $HV_{eq}$ as a measure of the hardness corresponding to a material having even hardness is defined by the following formula (5).

$$HV_{eq} = K_2 \int_0^a HV(r) r^2 dr \tag{5}$$

For the material having uniform hardness, from $HV_{eq}$= HV=constant, $K_2=3/a^3$ $$HV_{eq} = \frac{3}{a^3} \int_0^a HV(r) r^2 dr \tag{6}$$

From the equations (4) and (6), $$\tau_{max} = K_3 \cdot HV_{eq} \tag{7}$$

When a section having a radius a is divided into N concentric rings, the corresponding hardness $HV_{eq}$ can be approximated as follows:

$$HV_{eq} = \left( \sum_{n=1}^{N} HV_n \cdot r_n^2 \cdot \Delta r_n \right) \times \frac{3}{a^3} \tag{8}$$

wherein $HV_n$ is the harness of the nth ring, $r_n$ is the radius of the nth ring and $\Delta r_n$ is the width of the nth ring. This is again defined as the average in-section hardness HVa.

Figure 4:
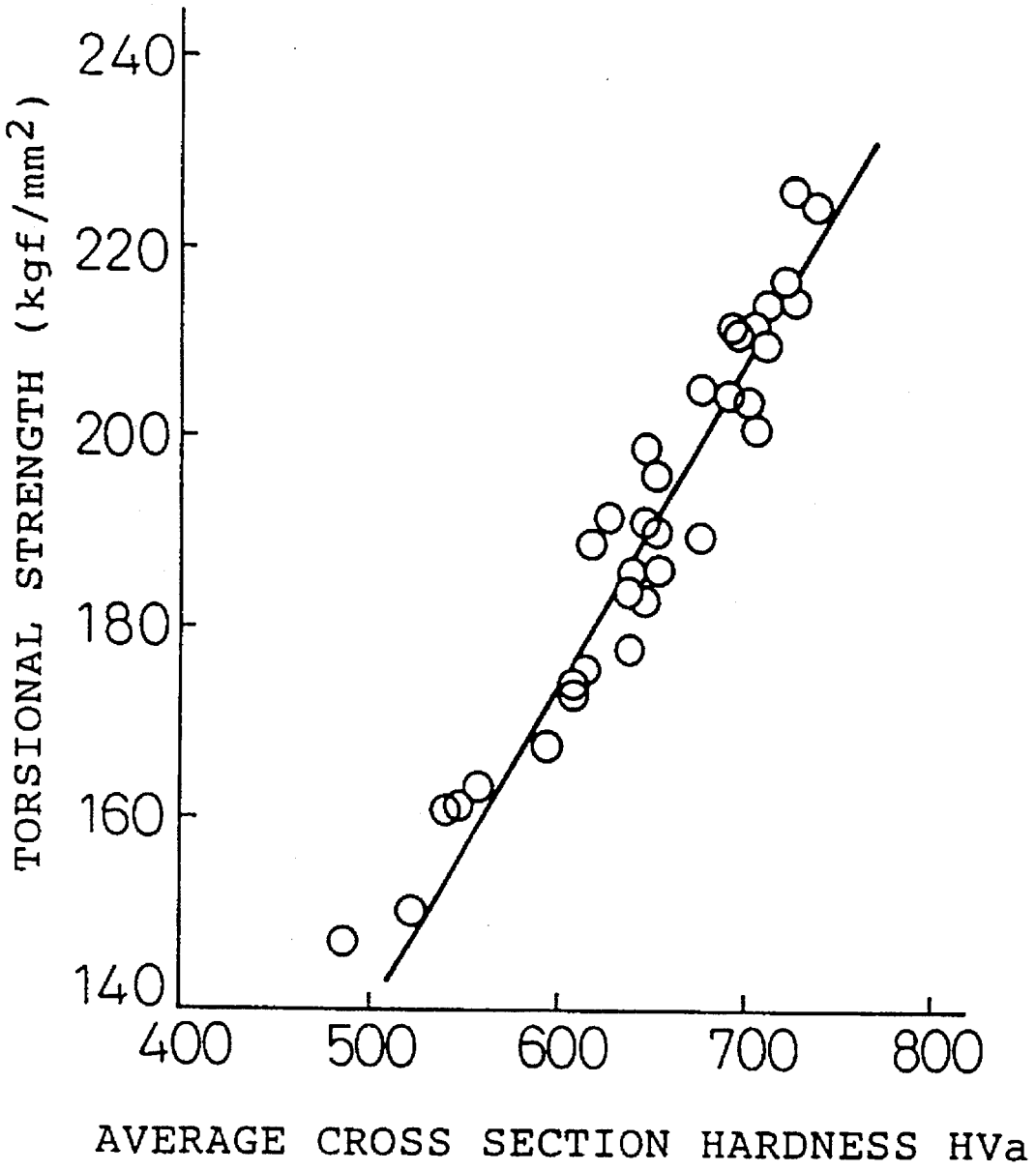
FIG. 4 is a diagram showing the relationship between the average cross section hardness (HVa) and the torsional strength for various materials.

FIG. 4 is a diagram showing the results obtained by determining the average hardness HVa for materials having various hardness distributions and arranging the torsional strength using HVa. From this drawing, it is apparent that there is a good correlation between the torsional strength and HVa and, in order to provide an excellent strength of not less than 160 kgf/mm$^2$, it is necessary for the HVa to be not less than 560.

(2) However, when the average in-section hardness is increased using a conventional material, the fracture mode is changed from "ductile fracture" to "brittle fracture originated from intergranular fracture," so that an increase in strength is saturated, or the strength is lowered. The use of a combination of the following techniques prevents the brittle fracture originated from intergranular fracture, thereby enabling the torsional strength to increase with increasing the average insection hardness. The technique comprises;

① An increase in Si content (to more than 1.0%)

② Addition of a very small amount of Mo

③ Reduction in P, Cu and O contents

④ Refinement of prior austenire grains by carbonitrides and MnS (addition of suitable amounts of Al and N, and increase in S content)

(3) The effect of increasing the torsional strength by the prevention of brittle fracture can be further improved by using the following techniques in addition to the above techniques. The technique comprises;

① Addition of Ti—B

② Application of compression residual stress by hard shot peening treatment (4) An increase in average in-section hardness in the above item (1) may cause quench crack to occur in the conventional material. Quench crack is prevented by taking measures as described in the above items (2) and (3).

The present invention has been made based on the above findings.

The present invention will now be described in more detail.

The present invention relates to a steel product for an induction-hardened shaft component, which has excellent torsional strength and does not cause any quench cracking.

At the outset, the reasons for the limitations on the above ingredient content ranges will be described.

C is a useful element for increasing the harmless of an induction-hardened layer. However, when the C content is less than 0.35%, the hardness is unsatisfactory. On the other hand, when it exceeds 0.70%, the precipitation of a carbide at austenite grain boundaries becomes so significant that the grain boundary strength is deteriorated, lowering the brittle fracture strength and, at the same time, the making quench cracking is likely to occur. For the above reason, the C content is limited to between 0.35 and 0.70%.

Si is added ① as an element for strengthening the grain boundary through the prevention of precipitation of a carbide at grain boundaries of austenire and ② as a deoxidizing element. However, when the Si content is not more than 0.15%, the effect is unsatisfactory. On the other hand, when it exceeds 2.5%, intergranular fracture is likely to occur. For tile above reason, the Si content is limited to between 0.15 and 2.5%.

When B is not added, the addition of Si in an amount exceeding 1.0% renders the effect of ① particularly significant.

Mn is added ① as an element for improving the hardenability and, at the same time, forming MnS in a steel, ② thereby refining austenire grains by heating in the step of induction hardening and ③ improving the machinability. However, when the Mn content is less than 0.20%, the effect is unsatisfactory. On the other hand, Mn is likely to cause intergranular segregation at the austenite grain boundaries and lowers the grain boundary strength, which causes brittle fracture to become liable to occur under torsional stress, resulting in lowered strength. This tendency becomes particularly significant when the Mn content exceeds 1.5%. For the above reason, the Mn content is limited to between 0.2 and 1.5%. When higher strength (=grain boundary strength) is contemplated, it is desirable for the Mn content to be 0.2% to less than 0.6% with the hardenability being ensured using Cr and Mo.

Cr serves to improve the hardenability, thereby ① increasing the hardness attained by induction hardening and increasing the hardening depth. When the Cr content is less than 0.20%, this effect is unsatisfactory. On the other hand, when it exceeds 1.50%, the effect is saturated and the toughness of the final product is deteriorated. For the above reason, the Cr content is limited to between 0.20 and 1.5%.

The effect of ① becomes significant particularly when the Cr content is added in an amount of not less than 0.4%.

Mo is added for the purpose of ① improving the hardenability and ② producing intergranular segregation at austenire grain boundaries to increase the grain boundary strength. However, when the Mo content is less than 0.05%, this effect is unsatisfactory. On the other hand, when it exceeds 0.5%, the intergranular embrittlement occurs. For the above reason, the Mo content is limited to between 0.05 and 0.5%.

S is added for the purpose of forming MnS in a steel, thereby refining austenite grains by heating in the step of induction hardening and, at the same time, improving the machinability. However, when the S content is less than 0.01%, the effect is unsatisfactory. On the other hand, when it exceeds 0.15%, the effect is saturated and, instead, the intergranular segregation occurs, resulting in intergranular embrittlement. For the above reason, the S content is limited to more than 0.01 to 0.15%.

Al is added ① as an element which combines with N to form AlN, thereby refining austenite grains by heating in the step of induction hardening and ② as a deoxidizing element. When the Al content is less than 0.015%, the effect is unsatisfactory. On the other hand, when it exceeds 0.05%, the effect is saturated and, rather, the toughness is deteriorated. For the above reason, the Al content is limited to between 0.015 and 0.05%.

N is added for the purpose of precipitating a carbonitride, such as AlN, to enable austenite grains to be refined by heating in the step of induction hardening. When the N content is less than 0.002%, the effect is unsatisfactory. On the other hand, when it exceeds 0.020%, the effect is saturated and, rather, the toughness deteriorates. For the above reason, the N content is limited to between 0.002 and 0.020%. When B is added, the addition of N in an amount in the range from 0.002 to 0.010% suffices for attaining the effect of N. When B is not added, the N content is preferably in the range from 0.005 to 0.020%.

P gives rise to intergranular segregation at austenite grain boundaries to lower the grain boundary strength, which increases the susceptibility to brittle fracture under torsional stress, so that the strength is lowered. The lowering in strength becomes significant particularly when the P content exceeds 0.015%. For the above reason, the upper limit of the P content is 0.015%.

As with P, Cu also causes intergranular segregation at austenite grain boundaries, which causes a lowering in strength. The lowering in strength becomes significant particularly when the Cu content exceeds 0.05%. For the above reason, the upper limit of Cu is 0.05%.

O causes intergranular segregation and intergranular embrittlement and, at the same time, forms hard oxide-based inclusions in a steel to increase the susceptibility to brittle fracture under torsional stress, which causes a lowering in strength. The lowering in strength becomes significant particularly when the O content exceeds 0.0020%. For the above reason, the upper limit of the O content is 0.0020%.

Ti also combines with N in a steel to form TiN. It is added for the purpose, by taking advantage of this effect, ① of refining austenite grains by heating in the step of induction hardening and ② of preventing the precipitation of BN by complete fixation of N in a solid solution form, i.e., ensuring that B is in a solid solution form. When the Ti content is less than 0.005%, the effect is unsatisfactory. On the other hand, when it exceeds 0.05%, the effect is saturated and, rather, the toughness is deteriorated. For the above reason, the content of Ti is limited to between 0.005 and 0.05%.

B is added for the purpose of increasing the grain boundary strength by taking advantage of such a phenomenon that B segregates in a solid solution form at grain boundaries of austenite to expel impurities present at grain boundaries, such as P and Cu. However, when the B content is less than 0.0005%, the effect is unsatisfactory. On the other hand, when it exceeds 0.005%, intergranular embrittlement occurs. For the above reason, the B content is limited to between 0.0005 and 0.005%.

The present invention provides a steel product for shaft components wherein austenite grains have been further refined during high-frequency heating to prevent intergranular fracture, thereby increasing the strength. Nb and V have the effect of forming carbonitrides in a steel to enable austenire grains to be refined by heating in the step of high-frequency heating. However, when the Nb content is less than 0.005% and the V content is less than 0.03%, the effect is unsatisfactory. On the other hand, when the Nb content exceeds 0.10% and the V content exceeds 0.50%, the effect is saturated and, rather, the toughness is deteriorated. The Nb content is limited to between 0.005 and 0.1% and the V content is limited to between 0.03 and 0.5%.

The present invention provides a steel product for shaft components wherein Ni has been added to improve the toughness in the vicinity of grain boundaries and prevent brittle fracture, thereby further improving the strength. However, when the Ni content is less than 0.1%, the effect is unsatisfactory. On the other hand, when it exceeds 3.5%, the toughness is deteriorated. For the above reason, the Ni content is limited between 0.1 and 3.5%.

The present invention provides a steel product for shaft components which additionally has good machinability. In the steel of the present invention, either or both of Ca and Pb can be incorporated for the purpose of improving the machinability. However, when the Ca content is less than 0.0005% and the Pb content is less than 0.05%, the effect is unsatisfactory. On the other hand, when the Ca content exceeds 0.005% and the Pb content exceeds 0.50%, the effect is saturated and, rather, the toughness is deteriorated. For the above reasons, the Ca content is limited to between 0.0005 and 0.005% and the Pb is limited to between 0.05 and 0.5%.

The present invention, directed to induction-hardened shaft components having excellent torsional strength, will now be described.

The reason why the induction-hardened shaft components according to the present invention have chemical compositions described in claims 1 to 6 and the average in-section hardness HVa, as defined above, is limited to not less than 560 will now be described. The torsional strength of the induction-hardened material improves in proportion to the average in-section hardness. In order to provide a torsional strength of not less than 160 kgf/mm$^2$, the average in-section hardness HVa should be not less than 560. When it is less than the above value, the torsional strength becomes unsatisfactory. For the above reason, the average in-section hardness HVa is limited to not less than 560.

Furthermore, the present invention provides a shaft component wherein austenire grains have been further refined in the step of induction heating to prevent intergranular fracture, thereby increasing the strength. The reason why the prior-austenite grain size number of the induction-hardened layer in the induction-hardened shaft component according to the present invention is limited to not less than 9 is that, if the grain size number is less than 9, the effect attained by the refinement at prior-austenite grain boundaries in the induction-hardened layer, i.e., the effect of preventing the brittle fracture caused by intergranular fracture, is small.

Furthermore, the present invention provides a shaft component wherein a large compression residual stress has been applied to the surface of an induction-hardened shaft component to prevent brittle fracture, thereby further increasing the strength. In the present invention, the reason why the residual stress of the surface of the induction-hardened shaft component is limited to not more than −80 kgf/mm$^2$ is that the application of the compression residual stress prevents brittle fracture, thereby increasing the torsional strength, and this effect becomes significant particularly when the surface residual stress is not more than −80 kgf/mm$^2$.

For the above reason, in the induction-hardened shaft components of the present invention, the induction hardening conditions and tempering conditions are not particularly limited, and the induction hardening and tempering may be carried out under any conditions so far as the requirements of the present invention can be satisfied. Further, the tempering may be omitted if the requirements of the present invention are satisfied. Furthermore, in the present invention, heat treatments, such as normalizing, annealing, spheroidizing and hardening(quenching)-tempering may be, if necessary, carried out prior to the induction hardening so far as the requirements of the present invention can be satisfied.

When normalizing, annealing and spheroidizing are not carried out prior to induction hardening, the production of the product by hot-rolling a material for a steel product is preferably carried out at a finishing temperature of 700° to 850° C. and an average cooling rate of 0.05° to 0.7° C./sec, in the temperature range of 700° to 500° C., after finish rolling.

In the induction-hardened shaft component of the present invention, the application of a compression residual stress can be effectively carried out by a hard shot peening treatment after induction hardening and tempering, which treatment is carried out at an intensity of not less than 1.0 mmA in terms of arc height. Here the arc height is a measure of the intensity of the shot peening as described in, for example, "Jidosha Gijutsu (Automotive Engineering)," Vol. 41, No. 7, 1987, pp.726–727. In the present invention, however, the conditions for the application of the compression residual stress are not particularly limited, and any conditions may be used so far as the requirements of the present invention can be satisfied.

The effect of the present invention will now be described in more detail with reference to the following example.

EXAMPLE

Steel products having respective compositions specified in Table 1 were rolled into 26 mmø rod steels. A drilling test specimen for the evaluation of machinability, a torsional test specimen and a specimen for the evaluation of susceptibility to quench crack were obtained from the rod steels. The machinability was evaluated as follows. The peripheral speed of a drill (material: SKH51-10 mmø) was varied with the feed rate being kept at 0.33 mm/sec. The total hole depth which causes the specimen to be undrillable any longer was measured for each speed. A peripheral speed rs. drill service life curve was prepared, and the maximum speed which provided a drill service life of 1000 mm was specified as $V_{L1000}$ and used as the evaluation standard. The evaluation results of $V_{L1000}$ are also summarized in Table 1. From Table 1, it is apparent that excellent machinability could be obtained for the steels of the present invention containing elements capable of improving the machinability.

Shaft components contemplated in the present invention have a stress concentrator (=notch), such as a spline, and breaking occurs from the notch. For this reason, the evaluation of the strength should be carried out for notched materials. Accordingly, a notched torsional test specimen having a 16 mmø parallel portion and, in its center portion, a notch having a tip R of 0.25 mm and a depth of 2 mm was used as a test specimen for the evaluation of torsional strength. The test specimen was subjected to induction hardening under conditions of A and B specified in Table 2 and then tempered at 170° C. for one hr. The above samples were subjected to a torsional test. After the induction hardening and tempering, some samples were subjected to a shot peening treatment under conditions of 1.1–1.5 mmA in terms of arc height.

Further, in order to evaluate the susceptibility to quench crack, a test specimen having a diameter of 24 mmø and a length of 200 mm and longitudinally provided with a notch having a tip R of 0.25 mm and a depth of 3 mm was subjected to induction hardening under conditions of C specified in Table 2, and observation was made on whether quench crack was present at the bottom of the notch.

In Table 1, steel Nos. 1 to 4, 12 to 17 and 21 to 38 are steels of the present invention, and steel Nos. 4 to 11, 18 to 20 and 39 to 40 are comparative steels.

The evaluation results of torsional strength for each steel product, together with the evaluation results of the ratio of effective hardening depth to radius (t/r), average in-section hardness (HVa), grain size (Nγ) of old austenite in the induction-hardened layer, surface residual stress and susceptibility to quench crack, are summarized in Table 3. The effective hardening depth is measured by a measuring method for induction-hardened depth specified in JIS G 0559.

As is apparent from Table 3, all the samples of the present invention had an excellent torsional strength of not less than 160 kgf/mm$^2$ and a low susceptibility to quench crack. Further, it is also apparent that, among the samples of the present. invention, samples having a grain size number of not less than 9 for an old austenite in the induction-hardened layer, or a surface residual stress of not more than −80 kgf/mm$^2$ could have a higher level of torsional strength.

By contrast, steel No. 4 as a comparative example is a sample having an average in-section hardness HVa of less than 560 and could not attain a torsional strength of not less than 160 kgf/mm$^2$.

For steel Nos. 4, 5, 6, 7 and 8 as comparative examples, at least one of C, Si, Cr, Mo and S contents is lower than the content range specified in the present invention, and for steel Nos. 9, 10. 11, 18, 19 and 20 as comparative examples, at least one of P, Cu, O, Nb, V and Ti is higher than the content range specified in the present invention. All the above comparative materials could not attain a torsional strength of not less than 160 kgf/mm$^2$. Further, among the comparative steel products, those which had a high carbon content and had unsatisfactory strength at the grain boundaries gave rise to quench crack.

TABLE 1

(wt. %)

| Classification | Steel No. | C | Si | Mn | Cr | Mo | S | Al | N | P | Cu | O | Ti | B | Nb | V | Ni | Ca | Pb | $V_{L1000}$ (m/min) |
|---|---|---|---|---|---|---|---|---|---|---|---|---|---|---|---|---|---|---|---|---|
| Steel of 1st invention | 1 | 0.38 | 1.27 | 0.49 | 1.41 | 0.24 | 0.045 | 0.031 | 0.0131 | 0.012 | 0.01 | 0.0014 | — | — | — | — | — | — | — | 17 |
| " | 2 | 0.52 | 0.31 | 0.82 | 1.10 | 0.32 | 0.082 | 0.028 | 0.0155 | 0.013 | 0.03 | 0.0015 | — | — | — | — | — | — | — | 15 |
| " | 3 | 0.66 | 1.72 | 0.46 | 0.50 | 0.47 | 0.124 | 0.033 | 0.0135 | 0.009 | 0.02 | 0.0008 | — | — | — | — | — | — | — | 11 |
| Comparative steel | 4 | 0.29 | 1.73 | 0.47 | 0.49 | 0.46 | 0.122 | 0.034 | 0.0075 | 0.012 | 0.01 | 0.0007 | — | — | — | — | — | — | — | 21 |
| " | 5 | 0.65 | 0.11 | 0.49 | 1.12 | 0.14 | 0.028 | 0.024 | 0.0054 | 0.013 | 0.04 | 0.0012 | — | — | — | — | — | — | — | 11 |
| " | 6 | 0.55 | 1.38 | 0.22 | 0.15 | 0.31 | 0.081 | 0.028 | 0.0086 | 0.012 | 0.03 | 0.0014 | — | — | — | — | — | — | — | 14 |
| " | 7 | 0.64 | 1.73 | 0.46 | 0.47 | 0.02 | 0.135 | 0.034 | 0.0075 | 0.009 | 0.03 | 0.0008 | — | — | — | — | — | — | — | 11 |
| " | 8 | 0.51 | 1.87 | 0.56 | 0.72 | 0.22 | 0.006 | 0.034 | 0.0075 | 0.012 | 0.02 | 0.0009 | — | — | — | — | — | — | — | 4 |
| " | 9 | 0.47 | 1.42 | 0.52 | 0.65 | 0.46 | 0.062 | 0.031 | 0.0042 | 0.021 | 0.02 | 0.0017 | — | — | — | — | — | — | — | 16 |
| " | 10 | 0.39 | 2.12 | 0.27 | 1.03 | 0.24 | 0.021 | 0.028 | 0.0083 | 0.013 | 0.11 | 0.0012 | — | — | — | — | — | — | — | 17 |
| " | 11 | 0.59 | 1.17 | 0.35 | 0.82 | 0.25 | 0.020 | 0.045 | 0.0053 | 0.012 | 0.04 | 0.0026 | — | — | — | — | — | — | — | 15 |
| Steel of 2nd invention | 12 | 0.38 | 2.33 | 0.57 | 0.73 | 0.45 | 0.062 | 0.037 | 0.0116 | 0.013 | 0.02 | 0.0013 | — | — | 0.015 | — | — | — | — | 16 |
| " | 13 | 0.67 | 1.83 | 0.43 | 0.46 | 0.47 | 0.126 | 0.034 | 0.0146 | 0.008 | 0.02 | 0.0009 | — | — | — | 0.08 | — | — | — | 11 |
| " | 14 | 0.37 | 2.41 | 0.53 | 0.63 | 0.48 | 0.062 | 0.031 | 0.0111 | 0.012 | 0.03 | 0.0018 | 0.032 | — | — | — | — | — | — | 17 |
| " | 15 | 0.54 | 1.35 | 0.51 | 0.73 | 0.33 | 0.056 | 0.045 | 0.0102 | 0.006 | 0.02 | 0.0014 | — | — | 0.008 | 0.36 | — | — | — | 15 |
| " | 16 | 0.44 | 1.57 | 0.35 | 1.42 | 0.09 | 0.092 | 0.037 | 0.0143 | 0.010 | 0.03 | 0.0016 | 0.015 | — | — | 0.10 | — | — | — | 16 |
| " | 17 | 0.63 | 1.14 | 0.49 | 1.34 | 0.16 | 0.025 | 0.027 | 0.0121 | 0.012 | 0.03 | 0.0011 | 0.018 | — | 0.031 | 0.17 | — | — | — | 12 |
| Comparative steel | 18 | 0.46 | 1.53 | 0.53 | 0.65 | 0.38 | 0.132 | 0.026 | 0.0023 | 0.008 | 0.02 | 0.0018 | — | — | 0.128 | — | — | — | — | 14 |
| " | 19 | 0.66 | 1.77 | 0.43 | 0.46 | 0.46 | 0.125 | 0.034 | 0.0073 | 0.009 | 0.02 | 0.0007 | — | — | — | 0.71 | — | — | — | 12 |
| " | 20 | 0.40 | 1.96 | 0.31 | 0.68 | 0.42 | 0.033 | 0.039 | 0.0036 | 0.008 | 0.01 | 0.0015 | 0.067 | — | — | — | — | — | — | 16 |
| Steel of 3rd invention | 21 | 0.38 | 0.28 | 0.52 | 1.37 | 0.26 | 0.018 | 0.031 | 0.0062 | 0.011 | 0.02 | 0.0016 | 0.035 | 0.0033 | — | — | — | — | — | 18 |
| " | 22 | 0.48 | 0.47 | 0.58 | 0.73 | 0.37 | 0.143 | 0.017 | 0.0024 | 0.009 | 0.01 | 0.0013 | 0.007 | 0.0008 | — | — | — | — | — | 15 |
| " | 23 | 0.67 | 0.72 | 0.46 | 0.49 | 0.47 | 0.125 | 0.034 | 0.0075 | 0.009 | 0.02 | 0.0008 | 0.019 | 0.0029 | — | — | — | — | — | 12 |
| Steel of 4th invention | 24 | 0.47 | 0.54 | 0.53 | 0.64 | 0.38 | 0.143 | 0.016 | 0.0023 | 0.009 | 0.01 | 0.0018 | 0.006 | 0.0007 | 0.081 | — | — | — | — | 17 |
| " | 25 | 0.36 | 0.28 | 0.55 | 1.23 | 0.20 | 0.018 | 0.031 | 0.0065 | 0.011 | 0.02 | 0.0016 | 0.036 | 0.0034 | — | 0.14 | — | — | — | 18 |
| " | 26 | 0.55 | 1.34 | 0.51 | 0.73 | 0.33 | 0.055 | 0.045 | 0.0032 | 0.006 | 0.02 | 0.0014 | 0.008 | 0.0016 | 0.007 | 0.37 | — | — | — | 15 |
| Steel of 5th invention | 27 | 0.47 | 1.48 | 0.55 | 0.73 | 0.32 | 0.142 | 0.017 | 0.0093 | 0.009 | 0.03 | 0.0013 | — | — | — | — | 1.75 | — | — | 17 |
| " | 28 | 0.38 | 2.33 | 0.93 | 0.75 | 0.47 | 0.067 | 0.037 | 0.0112 | 0.012 | 0.02 | 0.0013 | — | — | 0.016 | — | 2.52 | — | — | 17 |
| " | 29 | 0.65 | 1.85 | 0.44 | 0.46 | 0.23 | 0.126 | 0.034 | 0.0146 | 0.008 | 0.02 | 0.0008 | 0.022 | — | — | 0.08 | 2.35 | — | — | 11 |
| " | 30 | 0.54 | 1.34 | 0.54 | 0.75 | 0.19 | 0.048 | 0.045 | 0.0101 | 0.006 | 0. 0014 | 0.019 | — | 0.008 | 0.35 | 0.46 | — | — | 14 | |
| " | 31 | 0.47 | 0.47 | 0.55 | 0.73 | 0.32 | 0.142 | 0.017 | 0.0024 | 0.009 | 0.03 | 0.0013 | 0.007 | 0.0008 | — | — | 1.78 | — | — | 17 |
| " | 32 | 0.38 | 2.32 | 0.53 | 0.75 | 0.48 | 0.068 | 0.037 | 0.0042 | 0.013 | 0.02 | 0.0013 | 0.023 | 0.0023 | 0.018 | — | 2.54 | — | — | 18 |
| Steel of 6th invention | 33 | 0.46 | 1.57 | 0.33 | 1.43 | 0.08 | 0.092 | 0.028 | 0.0143 | 0.010 | 0.03 | 0.0015 | — | — | — | — | — | 0.0024 | — | 23 |
| " | 34 | 0.45 | 1.53 | 1.23 | 0.64 | 0.37 | 0.133 | 0.016 | 0.0093 | 0.009 | 0.02 | 0.0017 | — | — | 0.073 | — | — | 0.0038 | — | 22 |
| " | 35 | 0.42 | 1.94 | 0.81 | 0.67 | 0.42 | 0.043 | 0.037 | 0.0107 | 0.012 | 0.04 | 0.0012 | — | — | — | — | — | — | 0.12 | 20 |
| Steel of 6th invention | 36 | 0.42 | 1.94 | 0.71 | 0.66 | 0.19 | 0.045 | 0.037 | 0.0126 | 0.013 | 0.01 | 0.0014 | — | — | — | — | — | 0.0033 | 0.14 | 24 |
| " | 37 | 0.42 | 0.94 | 0.31 | 0.67 | 0.42 | 0.043 | 0.037 | 0.0036 | 0.012 | 0.04 | 0.0012 | 0.021 | 0.0024 | — | — | — | — | 0.12 | 23 |
| " | 38 | 0.58 | 1.77 | 0.55 | 0.73 | 0.25 | 0.111 | 0.038 | 0.0081 | 0.012 | 0.03 | 0.0009 | 0.044 | 0.0037 | 0.038 | — | — | 0.0008 | 0.09 | 22 |
| Comparative steel | 39 | 0.52 | 1.19 | 0.32 | 0.96 | 0.23 | 0.028 | 0.035 | 0.0051 | 0.011 | 0.01 | 0.0012 | — | — | — | — | — | 0.0073 | — | 24 |
| " | 40 | 0.45 | 1.96 | 0.31 | 0.69 | 0.42 | 0.043 | 0.038 | 0.0038 | 0.012 | 0.03 | 0.0012 | — | — | — | — | — | — | 0.71 | 26 |

TABLE 2

| Induction-Hardening Condition No. | Method | Frequency, KHz | Heating temp. °C. | Feed rate, mm/sec | Holding time, sec |
|---|---|---|---|---|---|
| A | Hardening with fixing | 10 | 1000 | — | 2 |
| B | Hardening with moving | 10 | 1000 | 15 | — |
| C | Hardening with moving | 10 | 1100 | 3 | — |

TABLE 3

| Classification | Data No. | Steel No. | Induction-Hardening Condition No. | Shot peening (arc height, mmA) | t/r | HVa | Nγ | Surface residual stress, kgf/mm² | Torsional strength, kgf/mm² | Quench crack |
|---|---|---|---|---|---|---|---|---|---|---|
| Ex. of 8th invention | 1 | 1 | A | Not done | 0.68 | 588 | 9.0 | −19 | 162.7 | None |
| " | 2 | 2 | A | Not done | 0.69 | 663 | 9.1 | −24 | 172.2 | None |
| Ex. of 9th invention | 2S | 2 | A | Done(1.2) | 0.68 | 663 | 9.1 | −101 | 187.4 | None |
| Ex. of 7th invention | 3 | 3 | A | Not done | 0.78 | 738 | 8.4 | −16 | 171.2 | None |
| Comp. Ex. | 4 | 4 | B | Not done | 0.47 | 512 | 10.5 | −41 | 147.1 | None |
| " | 5 | 5 | B | Not done | 0.50 | 692 | 9.4 | −25 | 157.7 | None |
| " | 6 | 6 | B | Not done | 0.35 | 562 | 10.5 | −21 | 153.1 | None |
| " | 7 | 7 | B | Not done | 0.45 | 681 | 10.2 | −27 | 148.2 | Occurred |
| " | 8 | 8 | B | Not done | 0.72 | 667 | 7.7 | −21 | 157.9 | None |
| " | 9 | 9 | B | Not done | 0.55 | 611 | 9.3 | −33 | 152.4 | Occurred |
| " | 10 | 10 | B | Not done | 0.75 | 587 | 10.3 | −26 | 152.1 | None |
| " | 11 | 11 | B | Not done | 0.46 | 648 | 9.6 | −39 | 152.8 | Occurred |
| Ex. of 7th invention | 12 | 12 | A | Not done | 0.80 | 583 | 8.9 | −16 | 167.3 | None |
| Ex. of 8th invention | 13 | 13 | B | Not done | 0.53 | 697 | 9.7 | −31 | 179.4 | None |
| " | 14 | 14 | B | Not done | 0.65 | 571 | 9.2 | −38 | 165.7 | None |
| Ex. of 7th invention | 15 | 15 | A | Not done | 0.78 | 657 | 8.6 | −29 | 174.8 | None |
| Ex. of 8th invention | 16 | 16 | B | Not done | 0.68 | 615 | 9.6 | −32 | 170.5 | None |
| Ex. of 7th invention | 17 | 17 | A | Not done | 0.86 | 719 | 8.6 | −17 | 172.3 | None |
| Comp.Ex. | 18 | 18 | B | Not done | 0.40 | 572 | 8.5 | −37 | 156.9 | None |
| " | 19 | 19 | B | Not done | 0.52 | 704 | 9.4 | −32 | 152.3 | None |
| " | 20 | 20 | B | Not done | 0.50 | 571 | 9.3 | −34 | 157.1 | None |
| Ex. of 7th invention | 21 | 21 | A | Not done | 0.73 | 593 | 8.7 | −21 | 163.4 | None |
| " | 22 | 22 | A | Not done | 0.75 | 645 | 8.2 | −23 | 172.1 | None |
| " | 23 | 23 | A | Not done | 0.81 | 746 | 8.5 | −17 | 174.1 | None |
| Ex. of 9th invention | 23S | 23 | A | Done(1.3) | 0.81 | 746 | 8.5 | −118 | 208.2 | None |
| Ex. of 7th invention | 24 | 24 | A | Not done | 0.81 | 640 | 8.7 | −16 | 172.3 | None |
| Ex. of 9th invention | 24S | 24 | A | Done(1.2) | 0.81 | 640 | 8.7 | −112 | 187.3 | None |
| Ex. of 8th invention | 25 | 25 | B | Not done | 0.57 | 567 | 9.7 | −38 | 163.0 | None |
| Ex. of 7th invention | 26 | 26 | A | Not done | 0.84 | 672 | 8.6 | −31 | 177.1 | None |
| " | 27 | 27 | A | Not done | 0.57 | 625 | 8.8 | −21 | 176.3 | None |
| " | 28 | 28 | A | Not done | 0.73 | 587 | 8.3 | −21 | 175.6 | None |
| Ex. of 8th invention | 29 | 29 | B | Not done | 0.78 | 732 | 10.0 | −20 | 171.2 | None |
| Ex. of 7th invention | 30 | 30 | A | Not done | 0.82 | 665 | 8.5 | −18 | 176.5 | None |
| " | 31 | 31 | A | Not done | 0.80 | 640 | 8.8 | −22 | 179.3 | None |
| " | 32 | 32 | A | Not done | 0.75 | 593 | 8.5 | −23 | 176.6 | None |
| " | 33 | 33 | A | Not done | 0.82 | 621 | 8.4 | −22 | 172.8 | None |
| Ex. of 7th invention | 34 | 34 | A | Not done | 0.75 | 611 | 8.6 | −22 | 168.5 | None |
| Ex. of 8th invention | 35 | 35 | B | Not done | 0.50 | 586 | 9.2 | −49 | 177.9 | None |
| Ex. of 7th invention | 36 | 36 | A | Not done | 0.82 | 617 | 8.3 | −23 | 171.3 | None |
| Ex. of 8th invention | 37 | 37 | B | Not done | 0.50 | 586 | 9.3 | −49 | 169.6 | None |
| " | 38 | 38 | A | Not done | 0.83 | 693 | 10.5 | −23 | 176.4 | None |
| Comp. Ex. | 39 | 39 | B | Not done | 0.45 | 626 | 8.5 | −35 | 152.6 | None |
| " | 40 | 40 | B | Not done | 0.50 | 601 | 8.6 | −36 | 147.8 | None |

[Industrial Applicability]

As described above, the present invention can provide steel products, for induction-hardened shaft components, having an excellent torsional strength of not less than 160 kgf/mm² and freedom from quench crack, and shaft components using the steel products, which renders the present invention very useful from the viewpoint of industry.

We claim:

1. A steel product for an induction-hardened shaft component having an excellent torsional strenqth of not less than 160 kqf/mm², having a chemical composition comprising, by weight:

C: 0.35 to 0.70%,

Si: not less than 0.72 and up to 2.5%,

Mn: 0.2 to 1.5%,

Cr: 0.20 to 1.5%,

Mo: 0.05 to 0.5%,

S: more than 0.01 to 0.15%,

Ai: 0.015 to 0.05%, and

N: 0.002 to 0.020%, and further comprising P, Cu and O in respective contents limited to P: not more than 0.015%, Cu: not more than 0.05%, and O: not more than 0 002%, with the balance consisting of iron and unavoidable impurities.

2. The steel product for an induction-hardened shaft component according to claim 1, which further comprises one or more members selected from Nb: 0.005 to 0.1%, V: 0.03 to 0.5%, and Ti: 0.005 to 0.05%.

3. A steel product for an induction-hardened shaft component havinq an excellent torsional strength of not less than 160 kgf/mm$^2$, having a chemical composition comprising, by weight:

C: 0.35 to 0.70%,

Si: not less than 0.72 and up to 2.5%,

Mn: 0.2 to less than 0.6%,

Cr: 0.40 to 1.5%,

Mo: 0.05 to 0.5%,

S: more than 0.01 to 0.15%,

Al: 0.015 to 0.05%,

Ti: 0.005 to 0.05%

B: 0.0005 to 0.005%, and

N: 0.002 to 0.010%, and further comprising P, Cu and O in respective contents limited to P: not more than 0.015%, Cu: not more than 0.05%, and O: not more than 0.0020%, with the balance consisting of iron and unavoidable impurities.

4. The steel product for an induction-hardened shaft component according to claim 3, which further comprises either or both of Nb: 0.005 to 0.1% and V: 0.03 to 0.5%.

5. The steel product for an induction-hardened shaft component according to claim 1, which further comprises Ni: 0.1 to 3.5%.

6. The steel product for an induction-hardened shaft component according to any one of claim 1, which further comprises either or both of Ca: 0.0005 to 0.005% and Pb: 0.05 to 0.5%.

7. An induction-hardened shaft component according to any one of claim 1, wherein regarding the hardness provided by the induction hardening, the average in-section hardness HVa defined by the following formula (1) is not less than 560:

average in-section hardness HVa:

$$HVa = \left( \sum_{n=1}^{N} HV_n \times r_n^2 \times \Delta r_n \right) \times \frac{3}{a^3} \quad (1)$$

wherein, when a section having a radius of a is concentrically divided in a radial direction into N rings, HVn is the hardness of the nth ring, $r_n$ is the radius of the nth ring and $\Delta r_n$ is the width of the nth ring.

8. The induction-hardened shaft component according to claim 7, wherein the grain size number of prior-austenite in an induction-hardened layer is not less than 9.

9. The induction-hardened shaft component according to claim 7, wherein the surface residual stress is not more than −80 kgf/mm$^2$.

10. The steel product for an induction-hardened shaft component according to claim 3, which further comprises Ni: 0.1 to 3.5%.

11. The steel product of an induction-hardened shaft component according to claim 3 which further comprises either or both of Ca: 0.0005 to 0.005% and Pb: 0.05 to 0.5%.

12. An induction-hardened shaft component according to claim 3, characterized in that, regarding the hardness provided by the induction hardening, the average in-section hardness HVa defined by the following formula (1) is not less than 560:

average in-section hardness HVa:

$$HVa = \left( \sum_{n=1}^{N} HV_n \times r_n^2 \times \Delta r_n \right) \times \frac{3}{a^3} \quad (1)$$

wherein, when a section having a radius of a is concentrically divided in a radial direction into N rings, $HV_n$ is the hardness of the nth ring, $r_n$ is the radius of the nth ring and $\Delta r_n$ is the width of the nth ring.

* * * * *

UNITED STATES PATENT AND TRADEMARK OFFICE

CERTIFICATE OF CORRECTION

PATENT NO. : 5,545,267
DATED : August 13, 1996
INVENTOR(S) : Tatsuro OCHI, et al.

It is certified that error appears in the above-indentified patent and that said Letters Patent is hereby corrected as shown below: Title page, item [57], ABSTRACT, line 1, change "all" to --an--.

Column 1, line 19, change "designates" to --designate--.

Column 1, line 24, change "systems" to --system--.

Column 1, line 25, delete "been" before "generally".

Column 1, line 27, change "components" to --component--.

Column 3, line 12, change "an prior" to --a prior--.

Column 4, line 29, change "ho" to --no--.

Column 4, line 37, "0" should go directly beneath "a", no space.

Column 4, line 47, "0" should go directly beneath "a", no space.

Column 4, line 50, "0" should go directly beneath "a", no space.

Column 4, line 64, "0" should go directly beneath "a", no space.

UNITED STATES PATENT AND TRADEMARK OFFICE

CERTIFICATE OF CORRECTION

PATENT NO. : 5,545,267

DATED : August 13, 1996

INVENTOR(S) : Tatsuro OCHI, et al.

It is certified that error appears in the above-indentified patent and that said Letters Patent is hereby corrected as shown below:

Column 5, line 3, "0" should go directly beneath "a".

Column 5, line 10, "0" should go directly beneath "a".

Column 5, line 21, "wherein" should be flush to left margin and "harness" should be changed to --hardness--.

Column 5, line 39, change "insection" to --in-section--.

Column 5, line 40, change "comprises;" to --comprises:--.

Column 5, line 45, change "austenire" to --austenite--.

Column 5, line 52, change "Ti-B" to --Ti-B--.

Column 6, line 1, change "harmless" to --hardness-.

Column 6, line 7, change "the making quench" to --making the quench--.

Column 6, line 8, delete "is".

Column 6, line 12, change "austenire" to --austenite--.

Column 6, line 16, change "tile" to --the--.

Column 6, line 23, change "austenire" to --austenite--.

UNITED STATES PATENT AND TRADEMARK OFFICE

CERTIFICATE OF CORRECTION

PATENT NO. : 5,545,267
DATED : August 13, 1996
INVENTOR(S) : Tatsuro OCHI, et al.

It is certified that error appears in the above-indentified patent and that said Letters Patent is hereby corrected as shown below:

Column 6, line 48, change "austenire" to --austenite--.

Column 7, line 59, change "austenire" to --austenite--.

Column 8, line 35, change "austenire" to --austenite--.

Column 9, line 34, change "rs." to --vs.--.

Column 10, line 31, delete the period after "present".

Table 1, line 33 , change "0.028" to --0.038--.

Table 2, column 13, insert --moving--under last --with--.

Talbe 2, column 14, delete "moving" under Method".

Table 3, column 14, line 6, change "0.69" to --0.68--.

Table, 3, column 13, line 4 , delete "Ex. of 7th inventio and insert ditto marks.

Column 13, line 56, change "[Industrial Applicability]" to --[INDUSTRIAL APPLICABILITY]-- and center.

Column 13, line 66, change "kqf/mm$^2$," to --kgf/mm$^2$,--.

UNITED STATES PATENT AND TRADEMARK OFFICE

CERTIFICATE OF CORRECTION

PATENT NO. : 5,545,267

DATED : August 13, 1996

INVENTOR(S) : Tatsuro OCHI, et al.

It is certified that error appears in the above-indentified patent and that said Letters Patent is hereby corrected as shown below:

Column 15, line 14, change "havinq" to --having--.

Column 15, line 46, delete "any one of".

Column 16, line 4, delete "any one of".

Column 16, line 4, after "wherein" insert a comma.

Column 16, line 28, after "claim 3" insert a comma.

Signed and Sealed this

Third Day of June, 1997

*Attest:*

*Attesting Officer*

Bruce Lehman

BRUCE LEHMAN

*Commissioner of Patents and Trademarks*